US005808632A

United States Patent [19]

Miura et al.

[11] Patent Number: 5,808,632

[45] Date of Patent: Sep. 15, 1998

[54] RECORDING APPARATUS AND METHOD USING INK JET RECORDING HEAD

[75] Inventors: Yasushi Miura, Kawasaki; Hisashi Fukushima, Yokohama; Haruhiko Moriguchi, Yokohama; Akio Suzuki, Yokohama, all of Japan

[73] Assignee: Canon Kabushiki Kaisha, Tokyo, Japan

[21] Appl. No.: 193,916

[22] Filed: Feb. 9, 1994

Related U.S. Application Data

[63] Continuation of Ser. No. 868,868, Apr. 16, 1992, abandoned, which is a continuation-in-part of Ser. No. 649,731, Feb. 1, 1991, abandoned.

[30] Foreign Application Priority Data

| | | | |
|---|---|---|---|
| Feb. 2, 1990 | [JP] | Japan | 2-022183 |
| Jul. 22, 1991 | [JP] | Japan | 3-180982 |

[51] Int. Cl.[6] ..... B41J 2/05

[52] U.S. Cl. ..... 347/12; 347/60

[58] Field of Search ..... 347/12, 13, 57, 347/60, 185, 186

[56] References Cited

U.S. PATENT DOCUMENTS

| | | | |
|---|---|---|---|
| 3,803,628 | 4/1974 | Van Brimer | 347/13 |
| 4,251,824 | 2/1981 | Hara | 347/57 |
| 4,266,232 | 5/1981 | Juiliana | 347/10 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,521,805 | 6/1985 | Ayata | 347/13 X |
| 4,536,774 | 8/1985 | Inui et al. . | |
| 4,558,333 | 12/1985 | Sugitani et al. . | |
| 4,567,488 | 1/1986 | Moriguchi et al. . | |
| 4,639,747 | 1/1987 | Sakurada | 347/12 |
| 4,712,172 | 12/1987 | Kiyohara | 347/60 X |
| 4,723,129 | 2/1988 | Endo | 347/57 |
| 4,740,796 | 4/1988 | Endo et al. . | |
| 4,806,950 | 2/1989 | Sekine et al. . | |
| 4,975,780 | 12/1990 | Kuboki . | |
| 4,982,199 | 1/1991 | Dunn . | |
| 5,006,867 | 4/1991 | Koizumi et al. . | |
| 5,107,276 | 4/1992 | Kneezel | 347/60 |
| 5,172,134 | 12/1992 | Kishida et al. . | |
| 5,381,164 | 1/1995 | Ono | 347/13 X |

FOREIGN PATENT DOCUMENTS

| | | | |
|---|---|---|---|
| 0300634 | 1/1989 | European Pat. Off. . | |
| 3839089 | 6/1989 | Germany . | |
| 54-056847 | 5/1979 | Japan . | |
| 55-164177 | 12/1980 | Japan | B41J 3/20 |
| 59-123670 | 7/1984 | Japan . | |
| 59-138461 | 8/1984 | Japan . | |
| 60-071260 | 4/1985 | Japan . | |
| 60-248357 | 12/1985 | Japan . | |
| 61-78671 | 4/1986 | Japan | B41J 3/20 |
| 61-239966 | 10/1986 | Japan . | |
| 62-164568 | 7/1987 | Japan | B41J 3/20 |
| 1-127361 | 5/1989 | Japan | B41J 3/04 |
| 2212691 | 7/1989 | United Kingdom . | |
| 2220892 | 1/1990 | United Kingdom . | |

*Primary Examiner*—Joseph W. Hartary
*Attorney, Agent, or Firm*—Fitzpatrick, Cella, Harper & Scinto

[57] ABSTRACT

A recording apparatus includes an ink jet recording head having plural ejection outlets and thermal energy generating elements provided for the respective ejection outlets; a limiter for defining a using range of the heat generating elements in accordance with image forming conditions, a recording head driver for supplying to the heat generating elements outside the using range defined by the limiter driving signals insufficient to eject the ink and for supplying to the heat generating elements in the using range defined by the limiter a driving signal sufficient to eject the ink in accordance with an image signal.

30 Claims, 11 Drawing Sheets

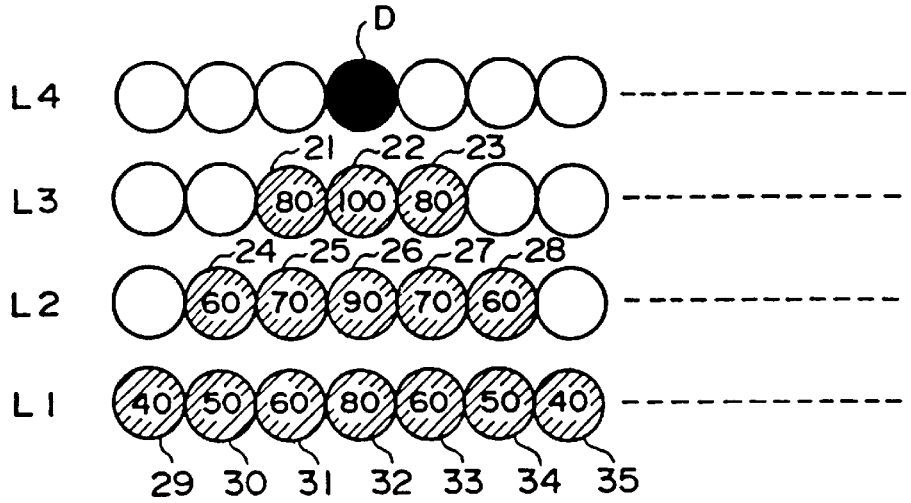
FIG. 4
FIG. 5(a)
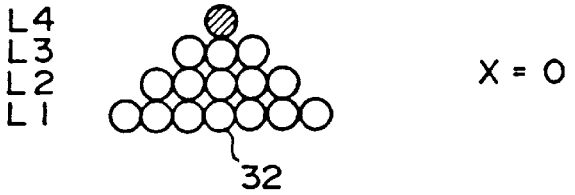
FIG. 5(b)
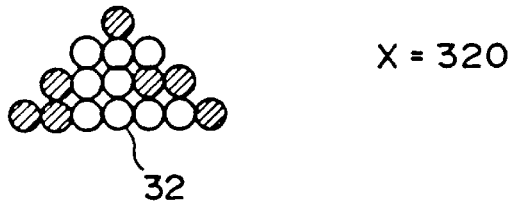
$X_{PH} = 330$
FIG. 5(c)
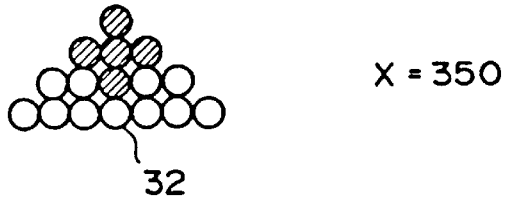
FIG. 5(d)
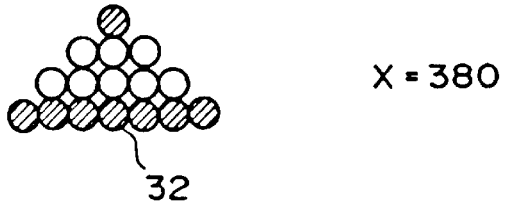

RECORDING APPARATUS AND METHOD USING INK JET RECORDING HEAD

This application is a continuation of application Ser. No. 07/868,868 filed Apr. 16, 1992, now abandoned, which is a continuation-in-part of 07/649,731 filed Feb. 1, 1991, abandoned.

FIELD OF THE INVENTION AND RELATED ART

The present invention relates to an ink jet recording apparatus and method using a recording head wherein liquid is ejected or discharged using thermal energy.

A liquid jet recording method includes ejecting or discharging a droplet of recording liquid through one of various processes, onto a recording material such as paper to effect recording.

Among the machines using the recording methods, a liquid jet recording apparatus of a type using thermal energy for the formation of the droplet of the liquid, which is advantageous from the standpoint of high density of the ejection outlets.

Such a liquid jet recording apparatus using the thermal energy as the liquid droplet ejecting energy, comprises liquid droplet formation means for forming a droplet of the recording liquid by heating the recording liquid, thus causing a state change of the liquid resulting in an instantaneous volume increase to eject the liquid through an ejection outlet, and an electrothermal transducer (heater) responsive to an electric signal to produce heat to heat the recording liquid. The droplet formation means and the electrothermal transducer are included in a recording head.

The recording liquid used in the liquid ejection recording apparatus, usually mainly contains water from the standpoint of proper recording properties and safety or the like. Such a recording liquid contains a recording material such as pigment or dye and a solvent for dispersing or dissolving the recording material, the solvent containing mainly water or water and water-soluble organic solvent.

In a recording apparatus using heat as the liquid ejection energy and in a recording apparatus of another liquid droplet formation type, the ejection outlet is often exposed to the ambience irrespective of drive thereof.

When the recording operation is uneffected for a long period of time, and particularly when the recording liquid is of a water-base type, the solvent such as the water and the volatile organic solvent evaporates from the recording liquid through the ejection outlet, with the result that the recording material and the solvent component which is not easily evaporated remains in the recording liquid. Then, the viscosity of the recording liquid containing the remainder increases, possibly to the extent that the viscosity exceeds the preferable range for the ejection of the recording liquid. Therefore, immediately after the resumption of the recording operation, ejection failure tends to occur, that is, the liquid is not ejected despite the application of the ejection signal. If this occurs, the recorded image involves defects at the portion where the initial recording is effected after the resumption.

When the temperature is low, the viscosity of the recording liquid increases with the tendency of similar improper ejection or ejection failure.

In order to avoid the problems arising from the existence of the non-recording period or the variation in the ambient conditions, Japanese Laid-Open Patent Application No. 248, 357/1985, for example, has made a proposal, in which in order to maintain the temperature of the recording liquid within a predetermined range, the heater is supplied with electric energy, immediately before the start of the printing, the electric power having such a level that the recording liquid is not ejected. By doing so, the printing operation is performed with stability because the recording liquid is heated. Depending on the presence or absence of the recording signal, the preliminary heating is controlled.

On the other hand, the printing is disturbed in some case even if the recording operation is continued. Particularly when the recording head is a multi-nozzle head having a plurality of recording elements arranged along one line, or a full-color multi-nozzle head having a plurality of such multi-nozzle heads, corresponding to the number of colors, the disturbances in the printed image density or in the printed color, relatively frequently occur.

The causes of them will be different from the above-described problems, and is considered as being related with the relative relation among recording elements occurring in the execution of the printing.

When such a pattern as results in non-printing state in a part of the multi-nozzle head, the increase in the viscosity of the recording liquid occurs due to the evaporation of the water content and the decrease of the recording liquid temperature at the ejection outlet or outlets corresponding to the non-recording part. The improper ejection may occur even during one line recording operation.

The temperature of the actuated ejection outlet or outlets is further increased by the thermal energy produced by the actuation, and therefore, a greater temperature difference results between the non-actuated portion and the actuated portion (ejection outlets). This results in a large viscosity difference therebetween, with the result of ejection performance difference in the diameter of the ejected droplet and in the ejection speed or the like. This is one of the causes of the image quality degradation.

U.S. Ser. No. 383,098 which has been abandoned in favor of U.S. Ser. No. 566,885 and U.S. Ser. No. 518,238, which matured into U.S. Pat. No. 5,006,867 have proposed in order to solve the problem of the improper ejection attributable to the temperature distribution described above, that a temperature sensor for detecting the temperature of the recording head is provided in the recording head, and the head temperature is controlled on the basis of the detected temperature.

In the case of copying machine using a multi-nozzle recording head, all of 256 nozzles (ink ejection outlets) of the recording head are used during one-to-one copy and enlarging copy operations. However, when a reduced copy is produced, for example, ½ image copy, the image data provided by an original reading optical element is reduced by ½, and only the upper or lower half of the nozzles are used.

In the case of the reduced copy operation, the liquid component of the ink in the unused nozzles, are evaporated for the same reason as described above, with the result of increase of the viscosity. It may be possible that the ink is not properly ejected when such nozzles are used again. In addition, the heat-is generated only in the used nozzle portions of the recording head, non-uniform distribution of the temperature occurs in the recording head with the result of non-uniform density of the image.

In the case in which the recording head is serially moved for the scanning, the length of the recording material measured in the sub-scan direction, is not always an integer multiple of the recording width of one scan of the recording head. In consideration of this, as disclosed in U.S. Pat. No. 4,975,780, one scan during the operation of the one page of the recording sheet, is selected, and in the selected scan, the recording operation is effected using only a portion of the nozzles, similarly to the case of the reducing operation. Then, the temperature distribution occurs in the recording head with the result of non-uniform image density, as in the case described above.

SUMMARY OF THE INVENTION

Accordingly, it is a principal object of the present invention to provide a liquid jet recording apparatus wherein the image quality degradation attributable to the improper ejection of the liquid is reduced.

It is another object of the present invention to provide an ink jet recording apparatus wherein the degradation of the image quality attributable to the temperature distribution is prevented without the necessity for the temperature sensor in the recording head.

It is a further object of the present invention to provide a recording apparatus and recording method suitable for use with an ink jet recording head using thermal energy.

According to an aspect of the present invention, there is provided a recording apparatus, comprising: an ink jet recording head having plural ejection outlets and thermal energy generating elements provided for the respective ejection outlets; signal supplying means for supplying a recording signal to said recording head; detecting means for detecting a state relating to heat, on the basis of the recording signal supplied from said signal supplying means; and control means, responsive to said detecting means, for actuating said thermal energy generating element.

According to another aspect of the present invention, there is provided a recording method using an ink jet recording head having plural ejection outlets and thermal energy generating elements provided for the respective ejection outlet, comprising: detecting states of actuations of said thermal energy generating elements for a predetermined period on the basis of record signals supplied to said recording head; effecting preliminary heating by actuation of said thermal energy generating element, when said detecting means detects that the thermal energy generating element is not actuated to a predetermined degree in the predetermined period; and effecting main heating step after said pre-heating step, for actuating the thermal energy generating element to effect recording in accordance with the record signal.

According to a further aspect of the present invention, there is provided a recording apparatus, comprising: an ink jet recording head having plural ejection outlets and thermal energy generating elements provided for the respective ejection outlets; means for defining a using range of the heat generating elements in accordance with an image forming condition; recording head driving means for supplying to said heat generating elements outside the using range defined by said defining means driving signals insufficient to eject the ink and for supplying to said heat generating elements in the using range defined by said defining means a driving signal sufficient to eject the ink in accordance with an image signal.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 illustrates the principle of an accumulation state detection.

FIGS. 5(*a*)–5(*d*) illustrate an example of the heat-accumulation state.

DESCRIPTION OF THE PREFERRED EMBODIMENTS

The embodiments of the present invention will be described in detail in conjunction with the accompanying drawings.

Figure 1:
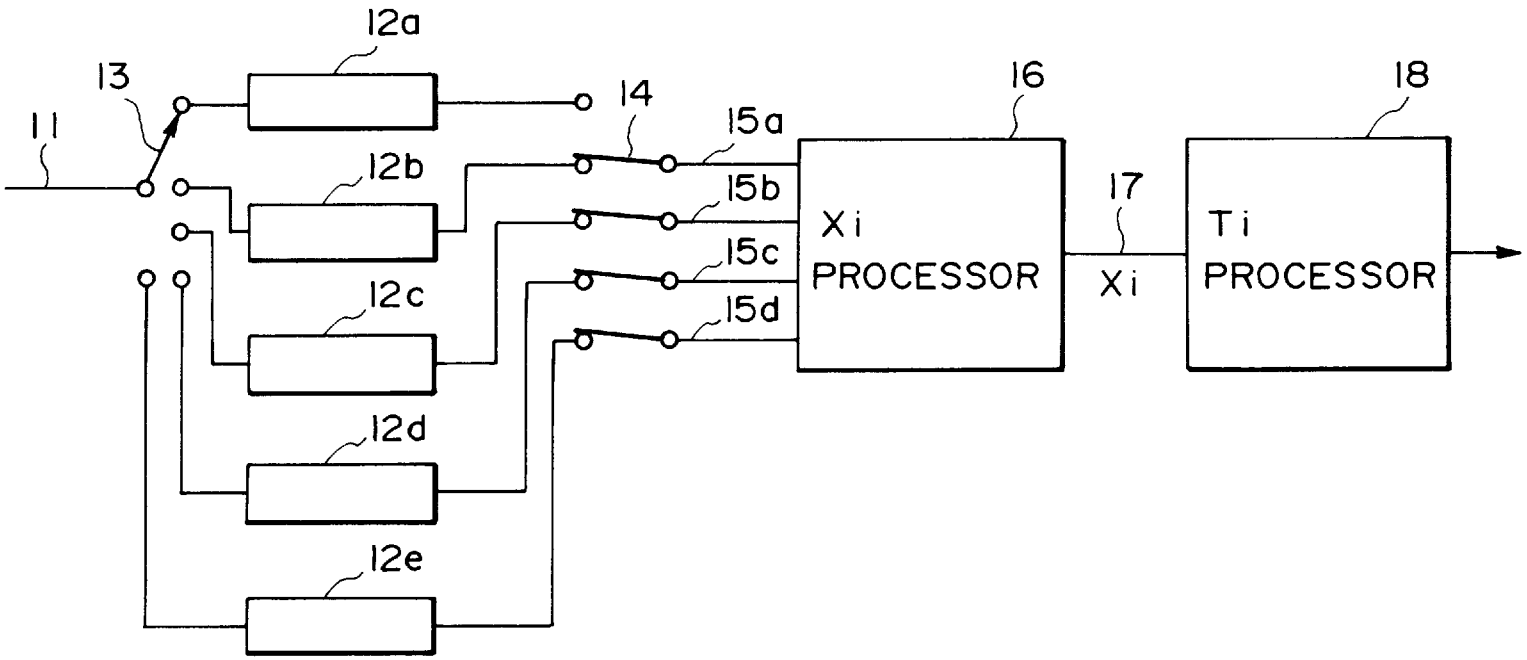
FIG. 1 is a block diagram of a system used in an ink jet recording apparatus according to an embodiment of the present invention.
Figure 2:
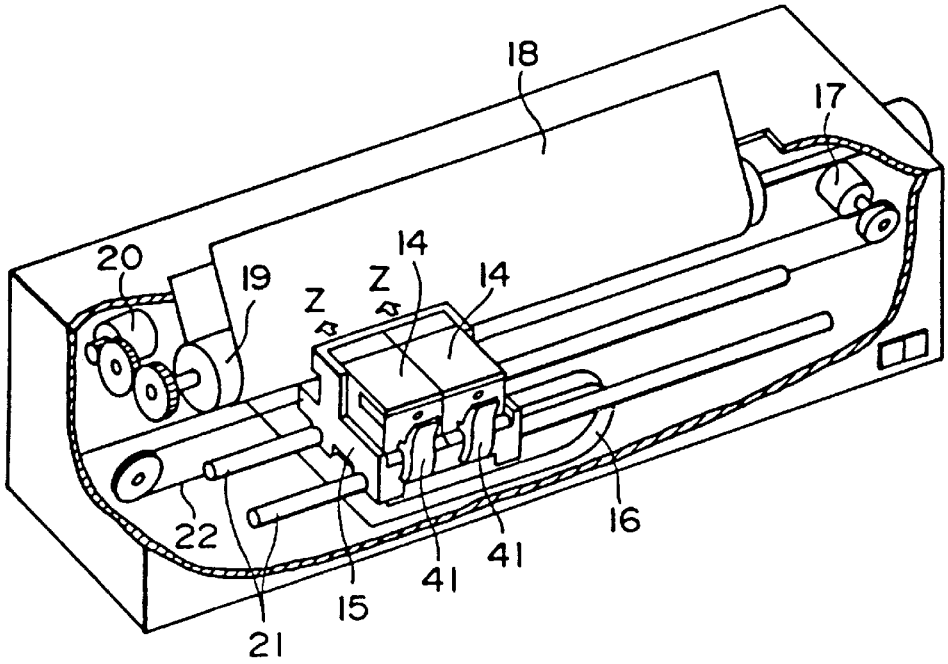
FIG. 2 PRIOR ART
FIG. 2 is a perspective view of a liquid jet recording apparatus according to an embodiment of the present invention.
Figure 3:
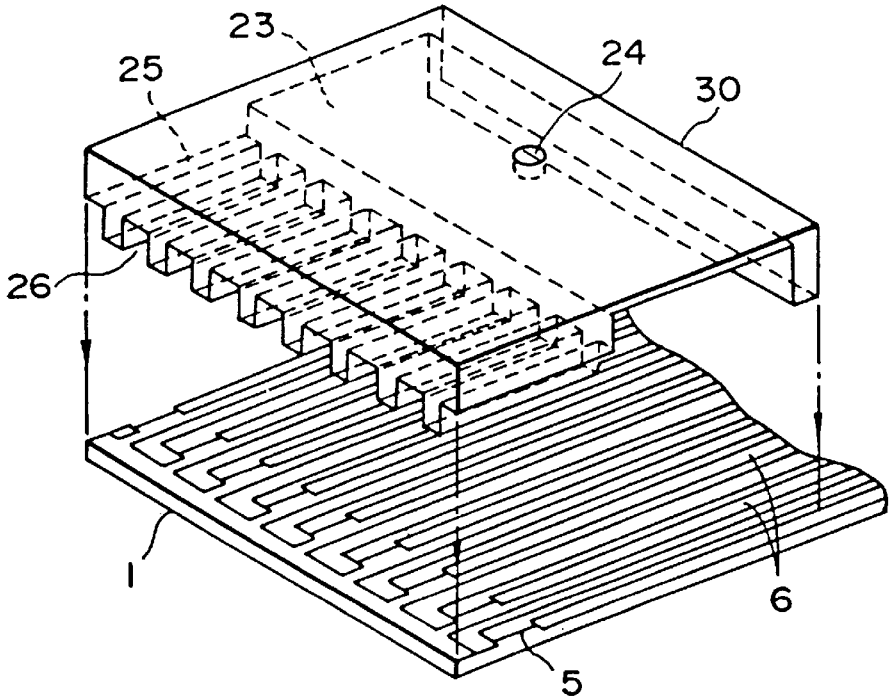
FIG. 3 PRIOR ART
FIG. 3 is a perspective view of a recording head cartridge used in the apparatus of FIG. 2.

FIGS. 1, 2 and 3 are a block diagram of a system used in an ink jet recording apparatus according to the present invention, the structure of the apparatus, and an example of a recording head used therewith, respectively.

Referring to FIG. 2, a recording head cartridge 14 includes as a unit a recording head having a heater board and an ink container as an ink supplying source. The head cartridge 14 is fixed on a carriage 15 by a confining member 41. The carriage 15 is reciprocable together with the cartridge 14 along a shaft 21. The ink ejected through the recording head reaches the recording medium 18 having a recording surface which is confined by a platen 19 with a small clearance from the recording head, so as to form an image on the recording material 18.

The recording head is supplied with ejection signals in accordance with the data representative of the image supplied from a proper data source through a cable 16 and contacts connected thereto. One or more head cartridges may be used in accordance with the color or colors of the ink materials to be used (two are used in the shown example).

Referring to FIG. 2, the carriage 15 is scanningly reciprocated along the shaft 21 by a carriage motor 17 through the wire 22. A feed motor 20 is coupled with the platen roller 19 to feed the recording material 18.

FIG. 3 shows an example of the recording head used in the apparatus of FIG. 2. The recording head comprises a heater board 1 having a silicone substrate, electrothermal transducers (ejection heaters) 5 formed thereon by a film forming process and wiring 6 made of aluminum or the like formed through the same process to supply electric power thereto. A liquid jet recording head is constituted by bonding to the heater board a top plate 30 having partition walls for defining liquid passages 25 for the recording liquid.

The liquid (ink) for the recording is supplied to a common liquid chamber 23 through a supply port 24 formed in the top plate 30, and from the common chamber 23 the ink is supplied to the respective liquid passages 25. When the heater 5 generates heat upon electric power supply, a bubble is formed in the ink filling the liquid passage 29, by which a droplet of the ink is ejected through the ejection outlet 26.

In FIG. 1, line buffers 12*a*–12*d*contain printing data 11 for consecutive lines, respectively. A selector 13 receives a line synchronization signal not shown, and it cyclically switches the contact each time the print data 11 for one line is supplied. When the selector 13 selects the first line buffer 12*a,* as shown in the figure, the print data for the line to be recorded are contained in a fifth line buffer 12*e.* At this time, a fourth line buffer 12*d* contains the data for the preceding line; a third line buffer 12*c* contains the data for the further preceding line; and the second line buffer 12*b* contains the print data for a further preceding line. A selector 14 is disposed at an output side of the line buffers 12*a*–12*e* to select the four line buffers other than the line buffer containing the currently printed data 11. In the state shown in the figure, the print data 11 are written in the first line buffer 12*a,* and therefore, the selector 14 selects the output sides of the other four line buffers 12*b*–12*e.*

Discriminating means in the form of an Xi processor 16 determines state of heat accumulation of the recording head on the basis of analyzing the print data 15*a*–15*d* selected by the selector 14. A Ti processor 18 functions as an electric current supplying means, in which on the basis of an output 17 of the Xi processor, a waveform of the pulse voltage applied to the heater to the individual liquid passages of the recording head is determined. In this embodiment, a liquid passage (nozzle) or passages to be supplied with preliminary heat are determined, using the Xi processor 16.

FIG. 4 illustrates the principle for the determination.

The bottom data line L1 in FIG. 4 represents the data which are going to be recorded. A line L2 immediately thereabove represents the data which are going to be recorded for the next line; a data line L3, the data for the second line; and a data line L4, a third line data.

A datum D (solid black) in the data line L4 (third line), is noted. A predicted heat-accumulation state X for the nozzle corresponding to the data, is expressed:

$$X = \sum_i a_i t_i$$

The data with suffix "i" are the data influential to the temperature of the nozzle corresponding to the noted data D, and more particularly, $t_i$ is quantity of generated heat, and $a_i$ is a temperature coefficient to the noted data.

In this embodiment, data 21–35 (15 in total) influential to the temperature are selected, and the data, among them to be recorded only are weighted (the figures in the data of FIG. 4), and are added, so that the state of heat accumulation corresponding to the data D is predicted.

When the prediction of the heat accumulated state X satisfies $X<X_{PH}$, the preliminary heating pulse is applied to the liquid passage (nozzle) corresponding to the noted data D within the limit not producing bubble.

More particularly, when the $t_i$ processor 18 is supplied with the prediction X satisfying $X<X_{PH}$, the $t_i$ processor 18 produces an output for the preliminary heating pulse signal such that the nozzle corresponding to the data D which is the data in the third line data line L4 after the current line data in line L1 to supply to the heat generating resistor in the nozzle to the extent that the liquid is not ejected, even if the datum corresponding to the datum (datum 32 in FIG. 4) corresponding to the datum D does not represents the necessity for the ejection.

More detailed description will be made using more specific examples.

FIGS. 5(*a*)–5(*d*) show the heat accumulation state predictions X in accordance with the weighted data of FIG. 4. In the cases in FIGS. 5(*a*) and 5(*b*), $X<X_{PH}$ is satisfied, and therefore, the preliminary heating is carried out; and in cases of FIGS. 5(*c*) and 5(*d*), $X \geqq X_{PH}$ is satisfied, and therefore, the preliminary heating is not carried out. As will be understood, the heat accumulation state after three more lines printings is predicted on the basis of the print data from the current time to the time corresponding to three lines after. On the basis of the prediction, the preliminary heating is executed at the current time. It will be understood from the data which will be described in the following that the above-described operation is effective.

Figure 6:
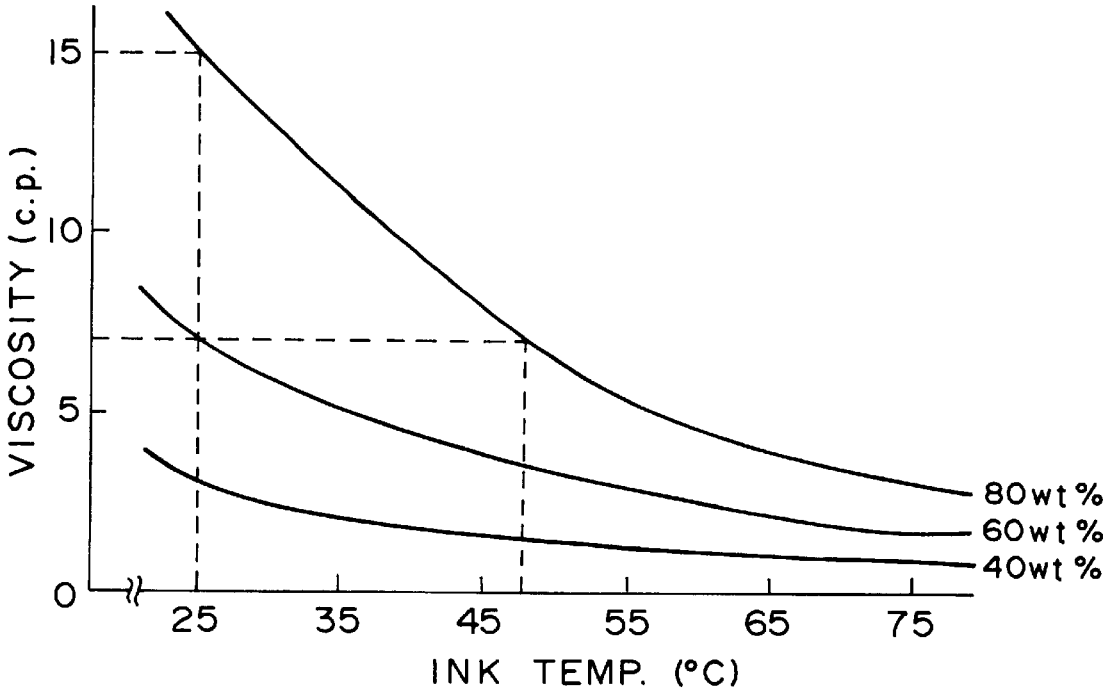
FIG. 6 is a graph showing a relation between an ink temperature and an ink viscosity, in an example.

As shown in FIG. 6, the viscosity of the ink decreases with increase of the temperature. FIG. 6 shows the weight content of diethylene glycol in the ink containing the dye (2%) in diethylene glycol containing water-solvent, at 40%, 60% and 80% by weight. The water content of the ink evaporates with time through the ejection outlets with the result of increase of the diethylene glycol content. Assuming that the liquid passage is capable of ejecting the ink if the viscosity thereof is not more than a critical ejection viscosity, e.g. 7 cp (centi-poise), it is capable of ejecting the ink containing not more than 60% by weight of the diethylene glycol at 25° C. If the content thereof becomes 80% by weight due to the water evaporation, it becomes unable to eject the ink with the result of defects in the recorded image. However, if the ink containing 80% by weight of the glycol is heated to approximately 47° C., the viscosity decreases beyond 7 cp, and therefore, the ejection is enabled.

It will be understood that on the basis of the continuous period of the non-print data using detection of the print data, the water content evaporation, and therefore, the glycol weight percentage, can be predicted. On the other hand, as described in the foregoing, the heat accumulation state can be predicted from peripheral data, and therefore, the head temperature (ink temperature) can be predicted. Thus, the discrimination is possible as to what extent the current temperature is to be changed using the curves of FIG. 6, in order to decrease the viscosity of the ink below the ejection limit viscosity (critical ejection viscosity).

In order to provide further high quality image, the following control may be used.

Figure 7A:
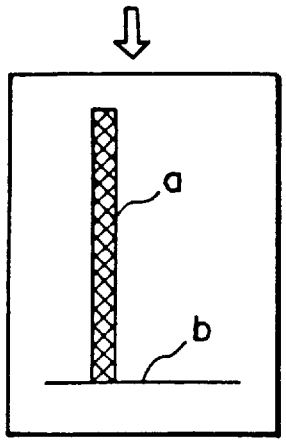
FIGS. 7(A)–7(C) illustrate control for providing a high image quality.
Figure 7B:
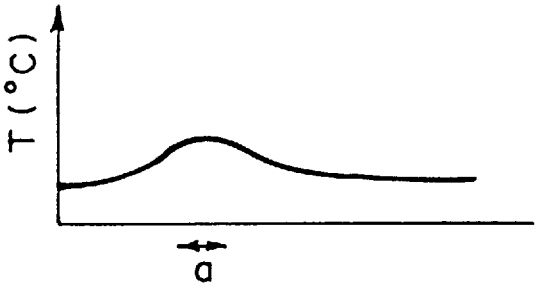

FIG. 7(A),(a) shows an image to be recorded. When the recording is effected while carrying out raster scans in the direction indicated by an arrow, the temperature adjacent the nozzle corresponding to a increases in accordance with printing a bar indicated by a. FIG. 7(B) shows the temperature distribution of the heat having plural nozzles, at the point of time at which the line b is recorded. As will be understood, the region a corresponding to the bar has a higher temperature.

Figure 8:
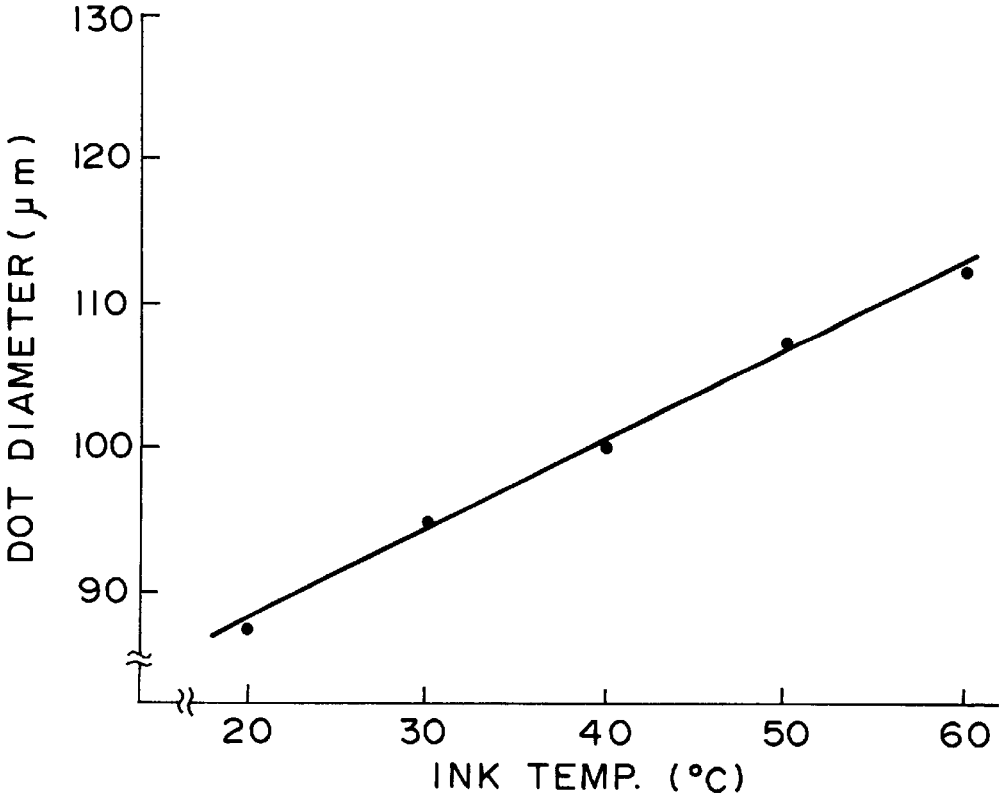
FIG. 8 is a graph showing an example of a relation between a printed dot diameter of and an ink temperature.
Figure 7C:
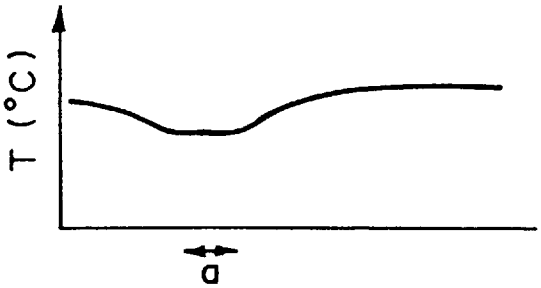

FIG. 8 shows a relation between an ink temperature and a print dot diameter. As will be understood from this Figure, the diameter of the print dot is higher if the temperature is higher. This is because the quantity of ejected liquid increases with the decrease of the ink viscosity by the increase of the ink temperature. Therefore, in the case of the temperature distribution shown in FIG. 7(B), the density non-uniformity occurs corresponding to the temperature distribution, even if the ejection is complete. Therefore, it is desirable in order to provide the uniform image density in line b that the temperature distribution shown in FIG. 7(C) is provided. The reason for the non-uniform temperature distribution is that the viscosity of the ink is increased due to the water evaporation in the region other than the region a, and therefore, the printed dot diameter, if any, becomes small, so that the increase of the temperature is desirable for compensation.

The fundamental point of the compensation is to determine the preferable temperature distribution in accordance with the print data, and the preliminary heating is performed so as to provide such a temperature distribution at the proper point of time. Therefore, in the example of FIGS. 7(A)–7(C), the preliminary heating is effected immediately before (several seconds before) the line b. The reason for this is that if the preliminary heating is effected at all times, the temperature distribution gradually saturates with the result that the viscosity increases because of the water content evaporation, as described above, and therefore,, the preferable distribution is not provided. The tendency is contained beforehand in the processor, and the determinations are made with reference to the print data as to the preliminary heating and the condition such as pulsewidth or the like of the preliminary heating. The preliminary heating is the heating in addition to the recording signal on the basis of the temperature distribution, but if the recording signal is coincident with the preliminary heating signal, the preliminary heating is carried out preceding the recording signal.

Figure 9:
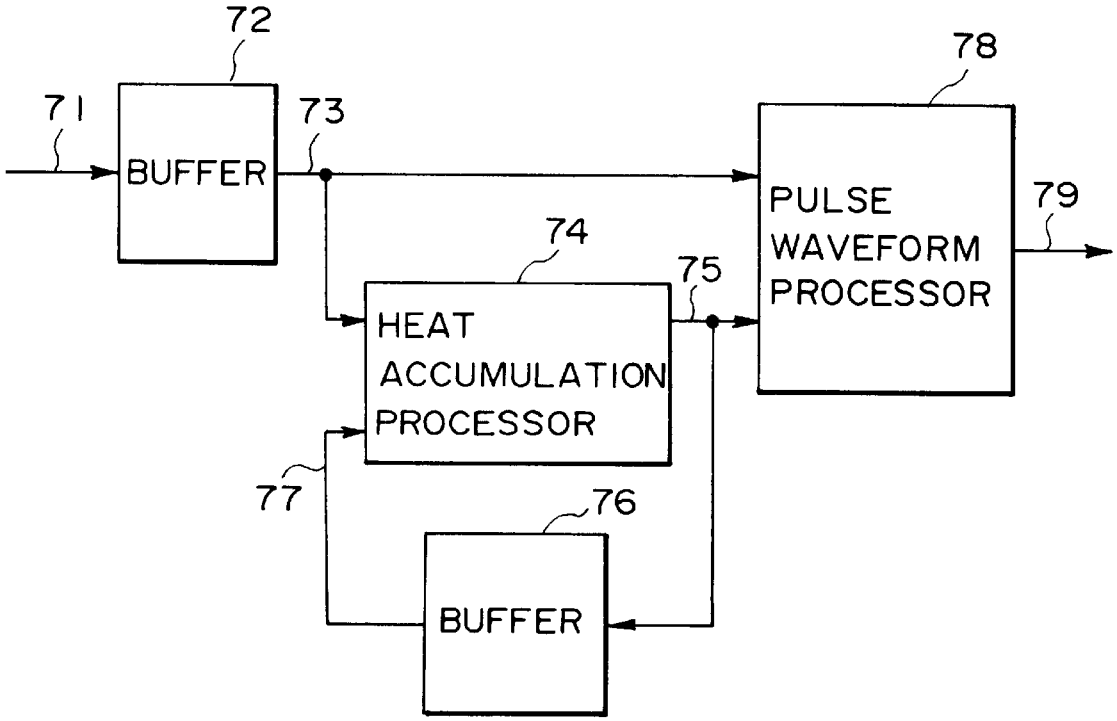
FIG. 9 is a block diagram of another example of a head driving circuit.

FIG. 9 shows a driving circuit for effecting the above (second embodiment).

The print data 71 are written line-by-line in print data buffers 72 including plural line buffers which are similar to the line buffers 12*a*–12*e* of FIG. 1. The written print data are transmitted in synchronism with line synchronization signal, in an accumulation state processor 74 as print data 73 corresponding to plural lines. The results 75 of the processing are transmitted to a buffer 76 for the results of the processing and to a pulse wave processor 78. In this embodiment, the state of heat accumulation is determined on the basis of the print data 73 and the results 77 of the heat accumulation state processing for one line before. A result 79 of the pulse waveform processing is obtained on the basis of the print data 73 and the results 75 of the accumulation state processing.

Referring to FIGS. 10(A)–10(E), the description will be made as to a part of change of the pulse waveform for each image by the above-described circuit when an image of FIG. 7(A) is recorded.

Figure 10A:
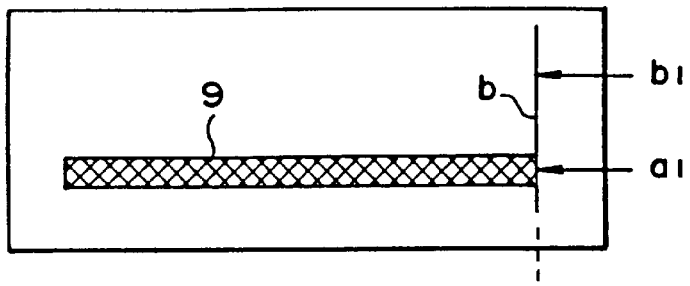
FIGS. 10(A)–10(E) are graphs showing an example of pre-heating operation.
Figure 10B:
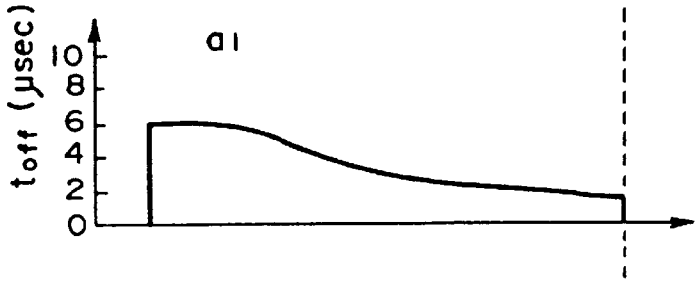
Figure 10C:
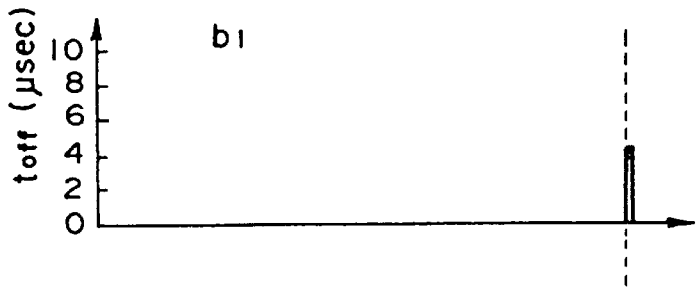
Figure 10D:
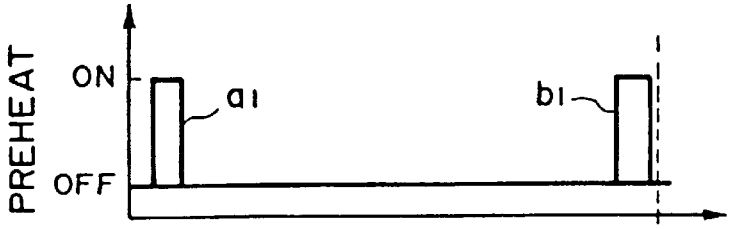
Figure 10E:
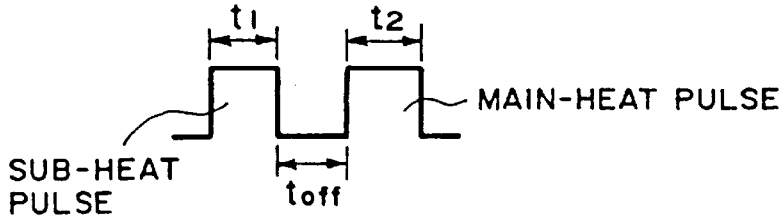

As for the nozzle corresponding to a position $a_1$ in the image shown in FIG. 10(A), a pre-heating pulse is applied to the ejection heater thereof for a predetermined period prior to start of the recording. Subsequently, ejection pulses (driving pulses) having the waveform shown in FIG. 10(E) are supplied to the corresponding nozzle. The ejection pulses include a sub-heat pulse for the temperature control and a main heating and ejecting pulse with a rest period $t_{off}$ therebetween. Here, the period $t_{off}$ varies, as shown in FIG. 10(B), in accordance with the position shown in FIG. 10(A). By reducing the rest period $t_{off}$ from 6 to 1 micro-sec., the quantity of the ejected ink is corrected to be smaller, thus compensating the tendency for the increase in the ejection quantity of the ink attributable to the increase of the accumulated heat, so that a constant level is maintained. Because of the reduction of the rest period $t_{off}$, the dissipation of the heat resulted by the sub-heating pulse becomes smaller, and therefore, upon the application of the main heating pulse, the temperature rise decreases. Therefore, the correction is toward reduction of the ink ejection quantity. As for the nozzle corresponding to a position $b_1$ in the image of FIG. 10(A), the pre-heating is effected, as shown in FIG. 10(D), immediately before the line b of FIG. 10(A). During the recording, corresponding to the line b, the ejection pulses shown in FIG. 10(E) are supplied with the rest period $t_{off}$ of 4 micro-sec., as shown in FIG. 10(C). Here, $t_1$=4 micro-sec., and $t_2$=6 micro-sec. with the waveform shown in FIG. 10(E).

The voltages of the sub-heating pulse and the main heating pulse are 23 V. Here, the ejection does not occur with the sub-heating pulse alone, but only the temperature increase results.

The pre-heating pulses $a_1$ and $b_1$ have the voltage level of 23 V and the duration of 4 micro-sec. Here, again, the ejection does not occur with the pre-heating pulse alone, but the temperature increase results only.

In the foregoing embodiment, the rest period $t_{off}$ is varied for the control, but the pulse width $t_1$ of the sub-heating pulse may be changed in place thereof. When the sub-heat pulse width $t_1$ is increased, the temperature increase of the ink increases, so that the viscosity of the ink reduces, thus increasing the quantity of ink ejection. As described in the foregoing, according to the present invention, the recording data are detected, and the passage in which the non-recording signal continues is pre-heated to the extent that liquid is not ejected. Therefore, the ejection failure during the recording is eliminated, and the variation in the ejection properties attributable to the temperature difference among the ejection outlets can be corrected, and therefore, good images can be produced.

In the foregoing embodiments, the state of heat accumulation is detected on the basis of the record data, and therefore, the necessity for the temperature sensor for the recording head is eliminated, thus simplifying the structure of the recording head.

Figure 11:
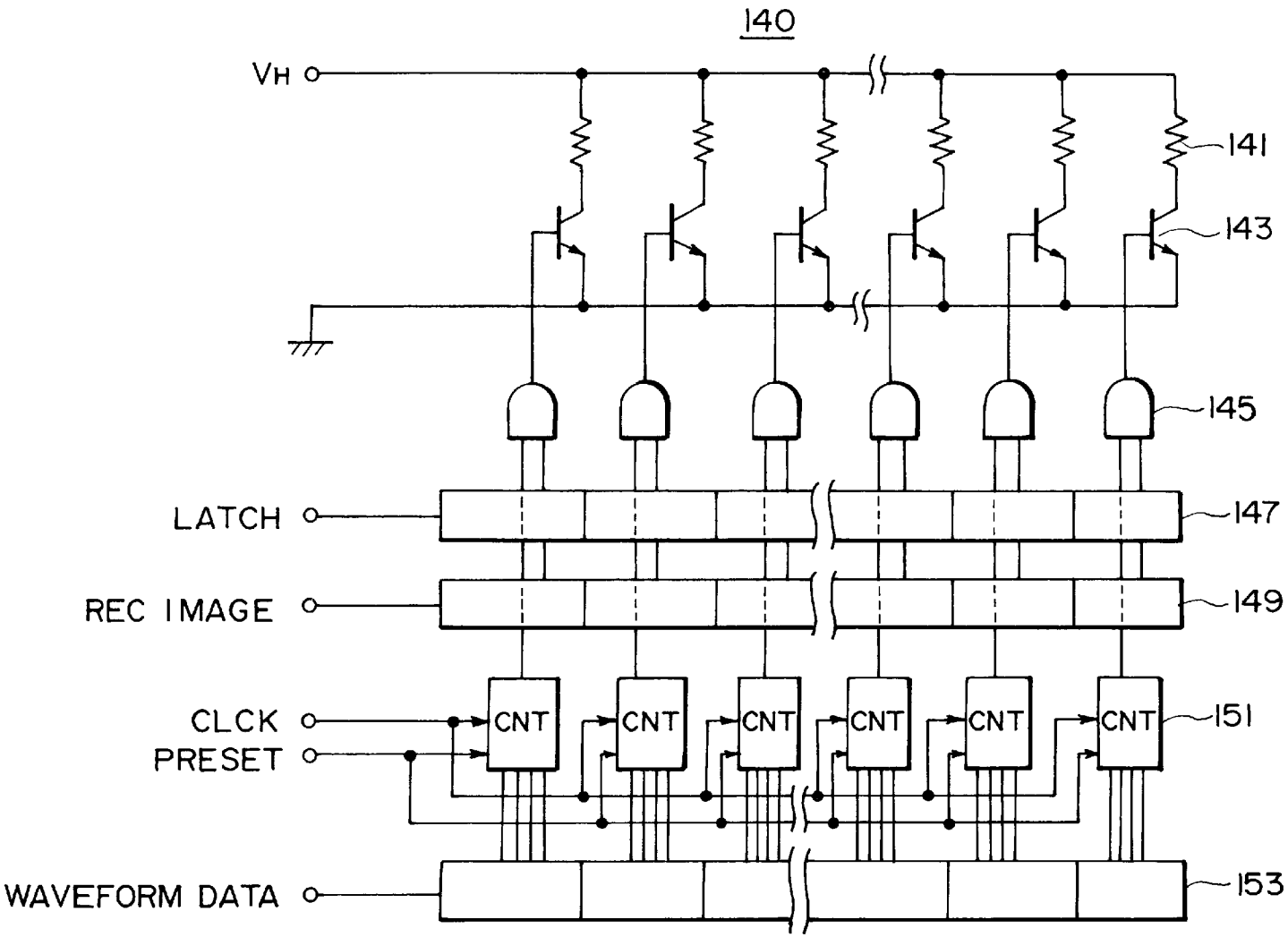
FIG. 11 is a circuit diagram of a head driving circuit according to a further embodiment of the present invention.

FIG. 11 shows an example of a head driving circuit 140 (third embodiment) contained in an ink jet recording apparatus. As shown in this Figure, a heat generating element (heater) 141 comprises an electrothermal transducer element provided for each of 256 ejection outlets, and it is effective to create a bubble in the ink by the heat thereof, so that a droplet of ink is ejected through an ejection outlet by the expansion and contraction of the bubble.

The voltage across each heat generating element 141 is maintained at a driving voltage VH through a switching transistor 143. A base of the transistor 143 is connected to an output of the corresponding AND gate 145.

In FIG. 11, a shift register 153 functions to store a waveform data signal serially supplied from a controller of the ink jet recording apparatus. The heater driving pulse in this embodiment is expressed as 16 stage pulse width. Therefore, continuing 4 bits of the waveform data signal constitute a waveform data of one heater driving pulse. Therefore, the shift register 153 is constituted as 265×4 bits corresponding to 256 heat generating elements 141.

A counter 151 is provided for each of the heat generating elements. In response to the pre-set signal from the recording apparatus controller (not shown), the waveform data are supplied in 4 bit-parallel from the shift register 153. The counter 151 is responsive to the waveform data and counts the clock pulses supplied from the controller until a value corresponding to the pulse width of the waveform is reached, and during the counting operation, it produces "H" at its output.

As shown in FIG. 11, a shift register 149 stores the signals representative of the image to be recorded serially supplied bit by bit, and is constituted in 256 bits corresponding to each of the heat generating elements 141.

A data buffer 147 latches in accordance with the latching signal the image signals supplied from the shift register 149. Each of the above-described AND gates 145 is supplied with a corresponding output of the data buffer 7 and an output of the corresponding counter 151.

Figure 12:
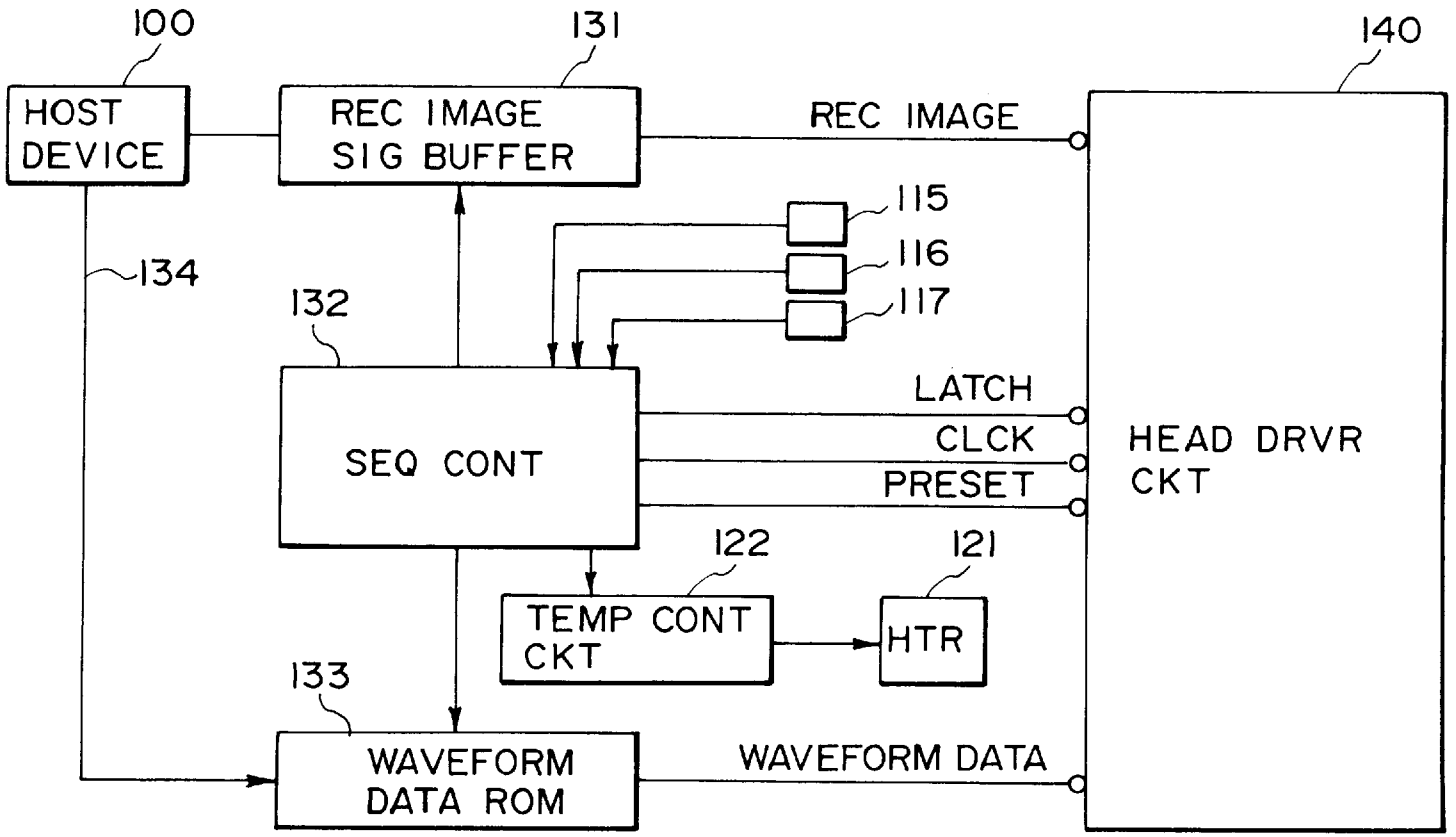
FIG. 12 is a block diagram of a head driving circuit according to a further embodiment of the present invention.

FIG. 12 is a block diagram of a controller for controlling the head driver circuit 140 when the above-described various signals are supplied to the head driver circuit 140.

An image signal buffer 131 functions to temporarily store the signal of an image to be recorded supplied from a host apparatus 100 such as an original reader or the like of a copying machine. The buffer 131 is effective to adjust timing difference between the image signal supply timing from the host apparatus and the recording head driving timing.

A waveform data ROM 133 stores the waveform data for the heater driving pulse. In this embodiment, a look-up-table system control is used. In accordance with reduction rate (signal 134) designated by the original reader, the nozzles to be used are selected. To the nozzles to be used, the pulse width capable of ejecting the ink for dot formation is supplied, and to the non-using nozzles, the pulse width insufficient to eject the ink, is supplied.

A sequence controller 132 comprising CPU or the like is effective to transfer the record image signal to the head driver circuit 140 from the image signal buffer 131 and to control the supply of the waveform data to the head driving circuit 140 from the waveform data ROM 133. It is also effective to supply the latching signals, clock signals and pre-set signals to the head driving circuit 140 at the proper timing.

The sequence controller 132 is responsive to the outputs of thermistors 115, 116 and 117 (temperature detecting means) disposed in the unshown recording head to maintain the recording head temperature at the proper level by controlling a heater 121 through a temperature control circuit 122, and it also functions to properly select the waveform data from the data stored in the waveform data ROM 133 and supply it to the recording head at the proper timing.

In this embodiment, the nozzles to be used are selected and determined in accordance with the reduction rate, for example, 128 nozzles are selected upon 50% reduction, and the selected nozzles are supplied with the voltage for 10 micro-sec (driving voltage of 25 V), and the non-used nozzles are supplied with the pulse wave of 3 micro-sec. By doing so, uniform density reduced images can be recorded without image defects.

Figure 13:
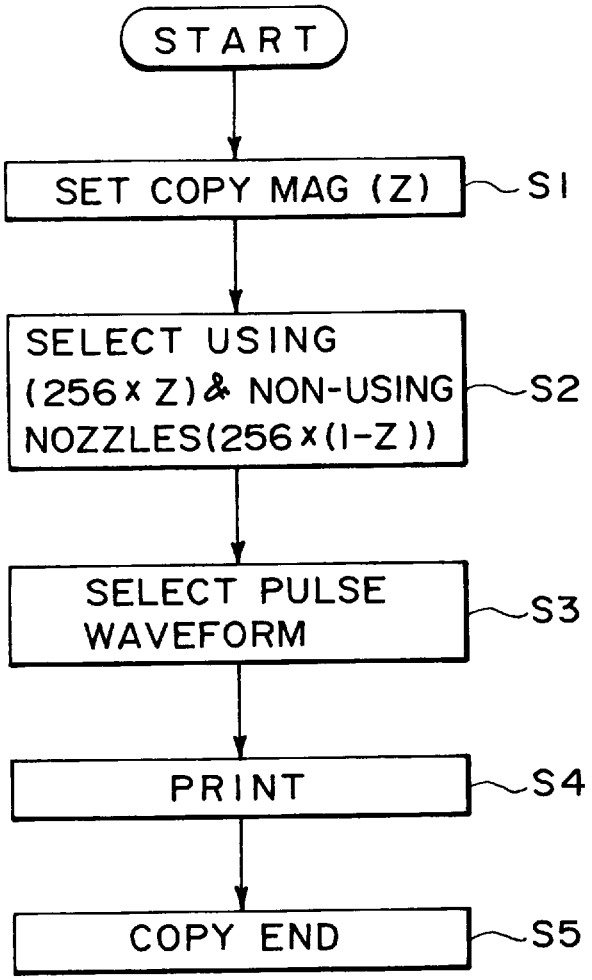
FIGS. 13 and 14 are flow charts illustrating sequential operations of an apparatus according to a further embodiment of the present invention.

Referring to FIG. 13, the controlling operation will be described. At step S1, the copy magnification (reduction) z is set in an operation panel not shown. In accordance with the set magnification z, the nozzles to be used and the nozzles not to be used are selected, that is, the nozzles to be used are defined, at step S2. At step S3, the pulse waveforms for the nozzles to be used and the nozzles not to be used are selected (10 micro-sec or 3 micro-sec). The printing operation is carried out at step S4 and is finished at step S5.

The description will be made as to a fourth embodiment in which, as disclosed in U.S. Pat. No. 4,975,780, during the recording operation repeating the scanning operations, the number of nozzles used changes. This is effective when the length of the recording sheet (measured in the sub-scan direction) is not an integer multiple of a one scan recording width.

In this embodiment, during the normal recording operation, the waveform data when all of the nozzles are used is selected in response to a signal from the sequence controller 132 shown in FIG. 12. For only one scan in the one recording operation for one page, the pulse waveform data insufficient to eject the ink (non-using nozzles) are selected and applied. By doing so, the uniform images can be provided without image defects all over the recording sheet.

Figure 14:
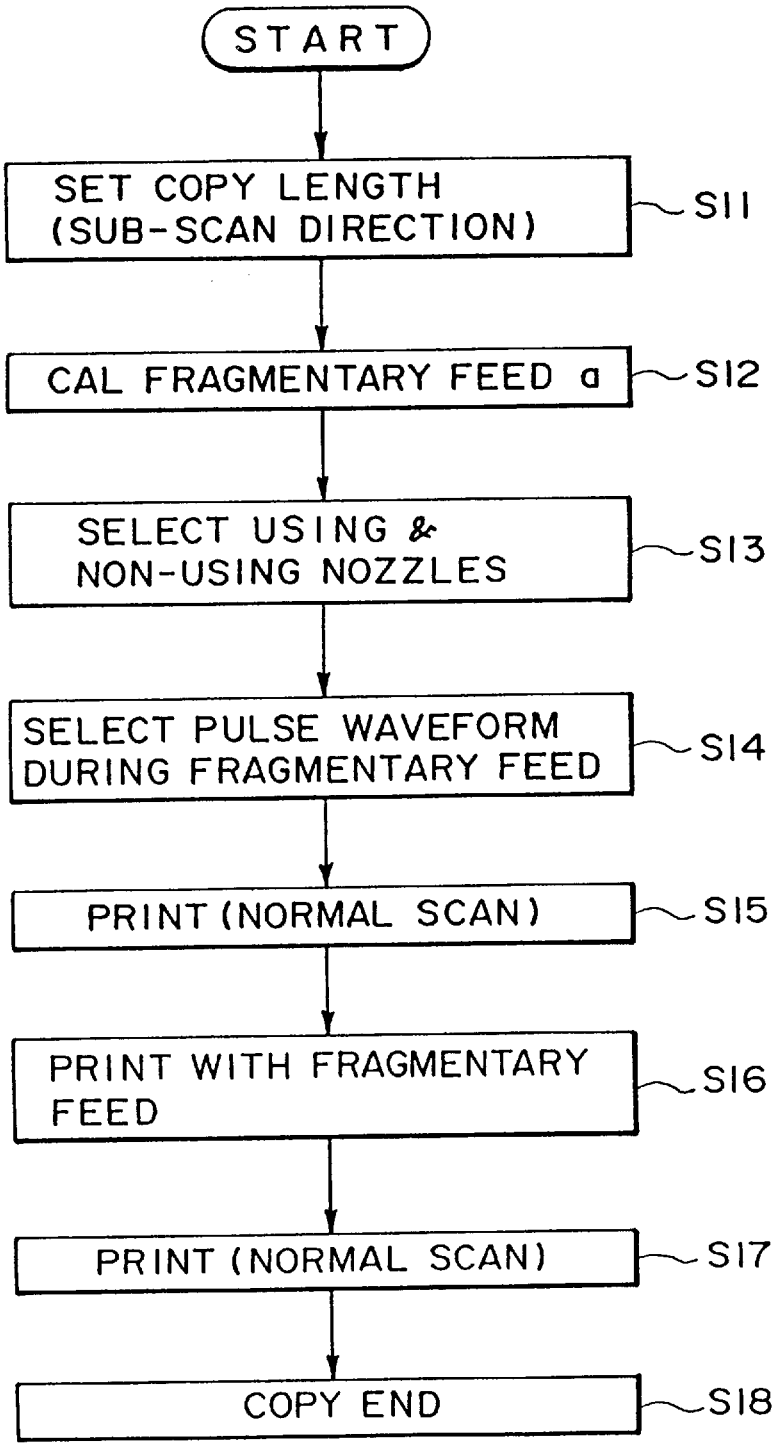

Referring to FIG. 14 (flow chart), the operation will be described. At step S11, the copy (record) length in the sub-scan (sheet feed) direction is selected on an operation panel. This may be made by setting the actual length of the recording material, or by setting the sheet size (A4 or the like). At step S12, a fragmental feed amount a is calculated, in response to which the nozzles to be used and the nozzles not to be used are selected at step S13, that is, the using region of the nozzles is defined. At step S14, a pulse waveform during the fragmental recording is selected.

At step S15, the printing operation is carried out with normal scanning operation using all of the nozzles. At step S16, in accordance with the using range and the pulse waveform selected at the steps S13 and S14, the fragmental part is printed. At step S17, the normal printing operation is effected with the normal scanning operation. At step S18, the printing operation is finished. At step S16, the pulse insufficient to eject the ink is supplied to each of the nozzles not used, and therefore, the uniform temperature distribution can be maintained, so that proper image recording operation is assured.

In the third and fourth embodiments, the invention has been described with respect to a recording head having 256 nozzles. However, the present invention is applicable to the case of full-multi-recording head having the number of nozzles corresponding to the width of the recording sheet. For example, when the recording head has a recording width of 297 mm (longer side of A4), the number of used nozzles changes when recording as opposed to recording when a sheet having a size lower than A4 is used, and therefore, the present invention is effectively used. Similarly to the third embodiment, the number of used nozzles changes during the reducing operation, and therefore, the present invention is applicable.

As described in the foregoing, according to the present invention, the heat generating elements in the non-using region are supplied with energy insufficient to eject the ink but produces sufficient to produce heat, and therefore, the temperature distribution of the recording head is maintained uniform, so that a uniform image without image defects can be provided.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied. The present invention is also applicable to other types of ink. In one of them, the temperature rise due to the thermal energy is positively prevented by consuming it for the state change of the ink from the solid state to the liquid state. Another ink material is solidified when it is unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for recording under a recording magnification of an image signal during a recording operation, said apparatus comprising:

an ink jet recording head having plural ejection outlets and heat generating elements provided for the respective ejection outlets for heating and ejecting ink, said recording head for receiving the image signal;

means for setting the magnification of the image signal, the magnification determining a number of heat generating elements to be used during the recording operation;

means for defining a using range of the heat generating elements in accordance with the magnification set by said setting means, the using range defining which heat generating elements of said plural heat generating elements are to be used to eject ink during the recording operation; and recording head driving means communicating with said ink jet recording head and with said defining means for supplying to said heat generating elements in the using range defined by said defining means, driving signals sufficient to eject the ink in accordance with the image signal under the magnification and for supplying to said heat generating elements outside the using range defined by said defining means, driving signals sufficient to heat the ink but insufficient to eject the ink within a recording period in which all of said heat generating elements can once be used during the recording operation.

2. An apparatus according to claim 1, wherein the recording magnification includes reduction.

3. An apparatus according to claim 2, wherein the reduction is substantially 50%.

4. An apparatus according to claim 1, wherein each heat generating element causes a change of state of the ink by heat produced thereby to eject a droplet of the ink.

5. An apparatus according to claim 4, wherein the change of state is formation of a bubble by film boiling.

6. An apparatus according to claim 1, wherein the driving signal sufficient to eject the ink has a longer pulse width than the driving signal insufficient to eject the ink.

7. A recording apparatus for recording on a recording material under a recording magnification of an image during a recording operation, said apparatus comprising:

an ink jet recording head having plural ejection outlets and heat generating elements provided for the respective ejection outlets for heating and ejecting ink;

means for reading an original and supplying the magnification;

means for setting the magnification of the image supplied by said reading means, the magnification being a condition that determines a number of heat generating elements to be used during the recording operation;

scanning means for imparting relative scanning movement between said recording head and the recording material;

means communicating with said scanning means for defining a using range of said heat generating elements in the scanning operation in accordance with the magnification set by said setting means, the using range defining which heat generating elements of said plural heat generating elements are to be used to eject ink during the recording operation; and recording head driving means communicating with said ink jet recording head and with said defining means for supplying to said heat generating elements in the using range defined by said defining means, driving signals sufficient to eject the ink in accordance with the magnification and for supplying to said heat generating elements outside the using range defined by said defining means, driving signals sufficient to heat the ink but insufficient to eject the ink within a recording period in which all of said heat generating elements can once be used during the recording operation.

8. An apparatus according to claim 7, wherein the recording magnification includes reduction.

9. An apparatus according to claim 8, wherein the reduction is substantially 50%.

10. An apparatus according to claim 7, wherein each heat generating element causes a change of state of the ink by heat produced thereby to eject a droplet of the ink.

11. An apparatus according to claim 10, wherein the change of state is formation of a bubble by film boiling.

12. An apparatus according to claim 7, wherein the driving signal sufficient to eject the ink has a longer pulse width than the driving signal insufficient to elect the ink.

13. An ink jet recording method for recording on a recording material under a recording magnification of an image signal during a recording operation, said method comprising the steps of:

providing an ink jet recording head having plural ejection outlets and heat generating elements provided for the respective ejection outlets for heating and ejecting ink, the recording head for receiving the image signal supplied from a source;

setting the magnification of the image signal, the magnification determining a number of heat generating elements to be used during the recording operation;

imparting relative scanning movement between the recording head and a recording material;

defining a using range of the heat generating elements in a scanning operation period in accordance with the magnification set in said setting step, the using range defining which heat generating elements of the plural heat generating elements are to be used to eject ink during the recording operation;

supplying, during the scanning operation period, to the heat generating elements in the using range defined in said defining step, a first driving signal sufficient to eject the ink in accordance with the image signal under the magnification; and supplying, during the scanning operation period, to the heat generating elements outside the using range defined in said defining step, second driving signals sufficient to heat the ink but insufficient to eject the ink within a recording period in which all of the heat generating elements can once be used during the recording operation.

14. A method according to claim 13, wherein the recording magnification includes reduction.

15. A method according to claim 14, wherein the reduction is substantially 50%.

16. A method according to claim 13, wherein each heat generating element causes a change of state of the ink by heat produced thereby to eject a droplet of the ink.

17. A method according to claim 16, wherein the change of state is formation of a bubble by film boiling.

18. A method according to claim 13, wherein the first driving signal has a longer pulse width than the second driving signal.

19. A recording apparatus for recording during a recording operation according to a length of a recording material measured in a sub-scan direction, said apparatus comprising:

an ink jet recording head having plural ejection outlets and heat generating elements provided for the respective ejection outlets for heating and ejecting ink, said recording head for receiving an image signal;

means for setting the length of the recording material, the length of the recording material determining a number of heat generating elements to be used during the recording operation;

means for defining a using range of the heat generating elements in accordance with the length of the recording material set by said setting means, the using range defining which heat generating elements of said plural heat generating elements are to be used to eject ink during the recording operation; and recording head driving means communicating with said ink jet recording head and with said defining means for supplying to said heat generating elements in the using range defined by said defining means, driving signals sufficient to eject the ink in accordance with the image signal according to the length of the recording material and for supplying to said heat generating elements outside the using range defined by said defining means, driving signals sufficient to heat the ink but insufficient to eject the ink within a recording period in which all of said heat generating elements can once be used during the recording operation.

20. An apparatus according to claim 19, wherein each heat generating element causes a change of state of the ink by heat produced thereby to eject a droplet of the ink.

21. An apparatus according to claim 20, wherein the change of state is formation of a bubble by film boiling.

22. An apparatus according to claim 19, wherein the driving signal sufficient to eject the ink has a longer pulse width than the driving signal insufficient to eject the ink.

23. A recording apparatus for recording on a recording material during a recording operation according to a length of the recording material, said apparatus comprising:

an ink jet recording head having plural ejection outlets and heat generating elements provided for the respective ejection outlets for heating and ejecting ink;

main scanning means for imparting relative scanning movement between said recording head and the recording material in a main scanning direction;

sub-scanning means for imparting a relative scanning movement between said recording head and the recording material in a sub-scan direction different from the main scanning direction;

means for setting the length of the recording material measured in the sub-scan direction, the length of the recording material determining a number of heat generating elements to be used during the recording operation;

means communicating with said main scanning means for defining a using range of said heat generating elements in the scanning operation in accordance with the length of the recording material set by said setting means, the using range defining which heat generating elements of said plural heat generating elements are to be used to eject ink during the recording operation; and recording head driving means communicating with said ink jet recording head and with said defining means for supplying to said heat generating elements in the using range defined by said defining means, driving signals sufficient to eject the ink in accordance with the length of the recording material and for supplying to said heat generating elements outside the using range defined by said defining means, driving signals sufficient to heat the ink but insufficient to eject the ink within a recording period in which all of said heat generating elements can once be used during the recording operation.

24. An apparatus according to claim 23, wherein each heat generating element causes a change of state of the ink by heat produced thereby to eject a droplet of the ink.

25. An apparatus according to claim 24, wherein the change of state is formation of a bubble by film boiling.

26. An apparatus according to claim 23, wherein the driving signal sufficient to heat the ink has a longer pulse width than the driving signal insufficient to eject the ink.

27. An ink jet recording method for recording on a recording material during a recording operation according to a length of a recording material measured in a sub-scan direction, said method comprising the steps of:

providing an ink jet recording head having plural ejection outlets and heat generating elements provided for the respective ejection outlets for heating and ejecting ink, the recording head for receiving an image signal supplied from a source;

setting the length of the recording material, the length of the recording material determining a number of heat generating elements to be used during the recording operation;

imparting relative scanning movement between the recording head and the recording material in a main scanning direction;

defining a using range of the he at generating elements in a scanning operation period in accordance with the length of the recording material set in said setting step, the using range defining which heat generating elements of the plural heat generating elements are to he used to eject ink during the recording operation;

supplying, during the scanning operation period, to the heat generating elements in the using range defined in said defining step, a first driving signal sufficient to eject the ink in accordance with the image signal according to the length of the recording material; and supplying, during the scanning operation period, to the heat generating elements outside the using range defined in said defining step, second driving signals sufficient to heat the ink but insufficient to eject the ink within a recording period in which all of the heat generating elements can once be used during the recording operation.

28. A method according to claim 27, wherein the first driving signal has a longer pulse width than the second driving signal.

29. A method according to claim 27, wherein each heat generating element causes a change of state of the ink by heat produced thereby to eject a droplet of the ink.

30. A method according to claim 27, wherein the change of state is formation of a bubble by film boiling.

* * * * *

UNITED STATES PATENT AND TRADEMARK OFFICE

CERTIFICATE OF CORRECTION

PATENT NO. : 5,808,632

DATED : September 15, 1998

INVENTORS : MIURA, ET AL.

It is certified that error appears in the above-identified patent and that said Letters Patent is hereby corrected as shown below:

COVER PAGE [57] ABSTRACT,
Line 6, "conditions," should read --conditions;--.

COLUMN 2,
Line 10, "case" should read --cases--;
Line 40, "U.S. Pat. No. 5,006,867" should read --U.S. Pat. No. 5,006,867,--; and
Line 61, "heat-is" should read --heat is--.

COLUMN 5,
Line 8, "12a-12dcontain" should read --12a-12d contain--.

COLUMN 6,
Line 3, "represents" should read --represent--; and
Line 50, "FIG. 7(A),(a)" should read --FIG. 7(A),--.

COLUMN 8,
Line 22, "increase" should be deleted.

COLUMN 10,
Line 47, "produces" should be deleted.

UNITED STATES PATENT AND TRADEMARK OFFICE

CERTIFICATE OF CORRECTION

PATENT NO. : 5,808,632

DATED : September 15, 1998

INVENTORS : MIURA, ET AL.

It is certified that error appears in the above-identified patent and that said Letters Patent is hereby corrected as shown below:

COLUMN 13,
Line 57, "elect" should read --eject--.

COLUMN 16,
Line 20, "he at" should read --heat--;
Line 24, "he" should read --be--; and
Line 44, "claim 27," should read --claim 29,--.

Signed and Sealed this

Fourth Day of May, 1999

*Attest:*

Q. TODD DICKINSON

*Attesting Officer*

*Acting Commissioner of Patents and Trademarks*